United States Patent [19]

Hosokai et al.

[11] Patent Number: 5,065,717

[45] Date of Patent: Nov. 19, 1991

[54] IDLE SPEED CONTROL SYSTEM FOR ENGINE

[75] Inventors: Tetsushi Hosokai; Tetsuro Takaba; Toshihiro Ishihara; Hideki Kobayashi, all of Hiroshima, Japan

[73] Assignee: Mazda Motor Corporation, Hiroshima, Japan

[21] Appl. No.: 634,601

[22] Filed: Dec. 27, 1990

[30] Foreign Application Priority Data

Dec. 28, 1989 [JP] Japan ..... 1-338511

[51] Int. Cl.[5] ..... F02D 41/16

[52] U.S. Cl. ..... 123/339

[58] Field of Search ..... 123/339, 585

[56] References Cited

U.S. PATENT DOCUMENTS

| | | | |
|---|---|---|---|
| 4,501,240 | 2/1985 | Aono | 123/339 |
| 4,667,632 | 5/1987 | Shimomura et al. | 123/339 |
| 4,716,871 | 1/1988 | Sakamoto et al. | 123/339 |
| 4,785,780 | 11/1988 | Kawai | 123/339 |
| 4,856,475 | 8/1989 | Shimomura et al. | 123/339 |
| 4,862,851 | 9/1989 | Washino et al. | 123/339 |
| 4,875,447 | 10/1989 | Kiuchi et al. | 123/339 |
| 4,884,540 | 12/1989 | Kishimoto et al. | 123/339 |

FOREIGN PATENT DOCUMENTS

| | | | |
|---|---|---|---|
| 0007752 | 1/1984 | Japan | 123/339 |
| 6232239 | 8/1985 | Japan . | |
| 2085619 | 4/1982 | United Kingdom | 123/339 |
| 2128779 | 5/1984 | United Kingdom | 123/339 |

*Primary Examiner*—Willis R. Wolfe

*Attorney, Agent, or Firm*—Sixbey, Friedman, Leedom & Ferguson

[57] ABSTRACT

An idle speed control system for an engine includes an idle regulator valve which controls the amount of intake air to be fed to the engine when the engine idles and a control unit which detects an engine speed and controls the opening of the idle regulator valve so that the detected engine speed converges on a target idle speed. The control unit calculates a basic air charging efficienty required to fixedly operate the engine at a target idle speed, calculates a first target air charging efficiency by feedback correction of the basic air charging efficiency on the basis of a correction value which is determined according to the difference between an actual idle speed and a target idle speed, calculates a second target air charging efficiency which is the air charging efficiency obtained when the engine is fixedly operated at a detected idle speed while the amount of intake air is kept at a mass flow which will fixedly provide the first target air charging efficiency, calculates a final target mass flow which provides a first-order lag air charging efficiency equal to the second target air charging efficiency, and controls the opening of the idle regulator valve on the basis of the final target mass flow.

1 Claim, 7 Drawing Sheets

IDLE SPEED CONTROL SYSTEM FOR ENGINE

BACKGROUND OF THE INVENTION

1. Field of the Invention

This invention relates to an idle speed control system for an engine which causes an idle regulator valve to control the amount of intake air to be fed to the engine when the throttle valve is closed so that the actual engine speed during idle converges on a target engine speed.

2. Description of the Prior Art

In recent electronic control engines, there has been in wide use the following idle speed control system as disclosed, for instance, in Japanese Unexamined Patent Publication No. 62(1987)-32239.

As shown in FIG. 9, an air cleaner 6, an airflow sensor 8, a throttle valve 10, an injector 12 are provided in an intake system 4 of an engine 2. A throttle position sensor 14 detects the opening of the throttle valve 10 and an idle switch 16 detects full closure of the throttle valve 10. A bypass passage 18 bypasses the throttle valve 10 and connects upstream and downstream sides of the throttle valve 10. An idle regulator valve (a solenoid valve) 20 is provided in the bypass passage 18.

Various sensors for detecting the operating condition of the engine 2 and the engine load condition, e.g., an intake air temperature sensor 22, an engine coolant temperature sensor 24, an engine speed sensor 26 and an air-fuel ratio sensor 28, are connected to a control unit 30. Though not shown, a compressor of an air conditioner, an oil pump of a power steering system and other auxiliary mechanisms are connected to the output shaft of the engine 2. In order to detect external load acting on the engine in response to driving of such auxiliary mechanisms, an air conditioner switch 32, a power steering switch 34 and the like are connected to the control unit 30.

The control unit 30 controls the engine 2 on the basis of information input from the sensors and switches.

The idle switch 16 is turned on when the throttle valve 10 is full closed. When the idle switch 16 is turned on, the control unit 30 determines a target idle speed No according to information on the operating condition of the engine such as the temperature of the engine coolant, whether external load is acting on the engine and the like, and calculates a basic mass flow of intake air required to maintain the target idle speed No. The control unit 30 corrects the basic mass flow according to the difference between the target idle speed No and the actual engine speed Ne, thereby obtaining a present target mass flow of intake air, and controls the opening of the idle regulator valve 20 on the basis of the target mass flow. After the next and later runs, so long as the target idle speed is not changed, the control unit 30 corrects the preceding target mass flow according to the target idle speed No and a newly detected actual engine speed Ne, thereby calculating a new target mass flow. In this way, the control unit 30 causes the difference between the target idle speed and the actual engine speed to converge on 0.

The idle regulator valve 20 is opened and closed by pulse signals of a sufficiently high predetermined frequency, and the effective opening degree of the idle regulator valve 20 is changed by changing the duty ratio of the pulse signals.

Generally, the engine speed is determined by the balance between the engine output torque and the load torque, and when the former is smaller than the latter, the engine speed is lowered. This will be described with reference to FIG. 10, hereinbelow.

In FIG. 10, line b represents the engine output torque (in terms of the air charging efficiency Cet1) required to operate the engine 2 at a given fixed speed. When the relation between the air charging efficiency and the engine speed is on the line b, the engine output torque conforms to the load torque and the engine speed is fixed.

The air charging efficiency Cetno when the engine 2 is fixedly operated at the target idle speed No with the mass flow of intake air kept at a value Gno required to fixedly operate the engine 2 at the target idle speed No is represented by the following formula (1).

$$Cetno = K \cdot (Gno/No) \quad (1)$$

Wherein K represents a mass flow-charging efficiency conversion coefficient.

Further, the air charging efficiency Cetne when the engine 2 is fixedly operated at a speed Ne with the mass flow of intake air kept at a value Gno required to fixedly operate the engine 2 at the target idle speed No is represented by the following formula (2).

$$Cetne = K \cdot (Gno/Ne) \quad (2)$$

The following formula (3) is derived from formulae (1) and (2).

$$Cetne = Cetno \times (No/Ne) \quad (3)$$

Line a in FIG. 10 represents formula (3).

When the opening of the idle regulator valve 20 is adjusted so that the mass flow of intake air is kept at a value Gno required to maintain the target idle speed No and the engine 2 is fixedly operated at a speed of Ne1by motoring, the air charging efficiency Cetne fed to the cylinder 2*a* of the engine 2 corresponds to the value for point A on the line a.

Since the air charging efficiency Cet1 required to maintain the engine speed Ne1 corresponds to the value for point A' on the line b, when motoring is interrupted in this state, a torque difference $T1 = Kt(Cet1 - Cetne)$ (Kt being a coefficient) which corresponds to the difference between the air charging efficiency Cet1 for point A' and the air charging efficiency Cetne for point A is produced and the engine 2 begins to decelerate. When it assumed that the actual air charging efficiency moves along the line a as the engine speed Ne lowers, the torque difference T1 is nullified when the engine speed Ne is equalized to the target idle speed No. At this time, the engine output torque and the load torque balance with each other and the engine 2 begins to fixedly operate at the speed No.

However, as is well known, in a transient state of the operating condition of the engine where the engine speed Ne changes even if the air mass flow is fixed, the actual air charging efficiency Cetned (a first-order lag air charging efficiency) changes every stroke cycle of the engine 2 in the manner represented by the following formula.

$$Cetned(i) = KSKCCA \cdot Cetned(i-1) + (1 - KSKCCA) \cdot Cetne(i) \quad (4)$$

wherein KSKCCA is a first-order lag coefficient.

Line c in FIG. 10 represents formula (4). As can be understood from line c, the torque difference T1 is larger than 0 at the time (point B) the engine speed Ne is equalized to the target idle speed No, and accordingly, the engine 2 further decelerates. Deceleration of engine 2 stops at the time (point C) Cetned becomes equal to Cet1. On the other hand, Cetned tends further increase and accordingly, the engine 2 comes to accelerate and finally the engine speed Ne converges on the target idle speed No. The graph shown in FIG. 11 shows such behavior of the engine speed.

When fuel feed is cut until the engine speed falls to a predetermined speed Ne2 during deceleration of the engine 2 as is commonly carried out, the engine output torque becomes 0 and accordingly the rate of deceleration increases. Further, when the engine 2 operates under external load such as the air conditioner, the power steering system and the torque convertor, the engine speed falls much more.

In the way described above, the engine speed falls when the engine speed is caused to converge on the target idle speed No during deceleration, and the engine speed falls because the first-order lag air charging efficiency Cetned at the time (point B) the engine speed Ne is transiently equalized to the target idle speed No during deceleration is short of the air charging efficiency Cetno which can balance with the engine load.

In order to overcome this problem, conventionally, the air mass flow is temporarily increased when deceleration of the engine is detected and thereafter gradually returned to the original value. However, this method is just like a symptomatic treatment and requires very large data for each of engines of different specifications in order to conform it all the operating conditions of the engine. Further, it requires a very complicated control program and experience to get matching.

Further, recently, there has been a trend toward enlargement of the volume of the intake passage downstream of the throttle valve, which leads to increase in the time lag before the air the flow rate of which is controlled by the idle regulator valve 20 is actually enters the cylinder, thereby causing the engine speed to fall more.

SUMMARY OF THE INVENTION

In view of the foregoing observations and description, the primary object of the present invention is to provide an idle speed control system for an engine which can better converge the actual engine speed during idle on a target idle speed.

In accordance with the present invention, there is provided an idle speed control system for an engine comprising an idle regulator valve which controls the amount of intake air to be fed to the engine when the engine idles and a control unit which detects an engine speed and controls the opening of the idle regulator valve so that the detected engine speed converges on a target idle speed, characterized in that said control unit has a basic air charging efficiency calculating means which calculates a basic air charging efficiency required to fixedly operate the engine at the target idle speed, a first target air charging efficiency calculating means which calculates a first target air charging efficiency by feedback correction of the basic air charging efficiency on the basis of a correction value which is determined according to the difference between the detected engine speed and the target idle speed, a second target air charging efficiency calculating means which calculates a second target air charging efficiency which is the air charging efficiency obtained when the engine is fixedly operated at the detected engine speed while the amount of intake air is kept at a mass flow which will fixedly provide the first target air charging efficiency, a final target mass flow calculating means which calculates a final target mass flow which provides a first-order lag air charging efficiency equal to the second target air charging efficiency, the first-order lag air charging efficiency being an air charging efficiency which is actually introduced into the cylinder when the opening of the idle speed regulator valve is set so that a given mass flow is obtained, and a valve control means which controls the opening of the idle regulator valve on the basis of the final target mass flow.

DESCRIPTION OF THE PREFERRED EMBODIMENT

Figure 9:
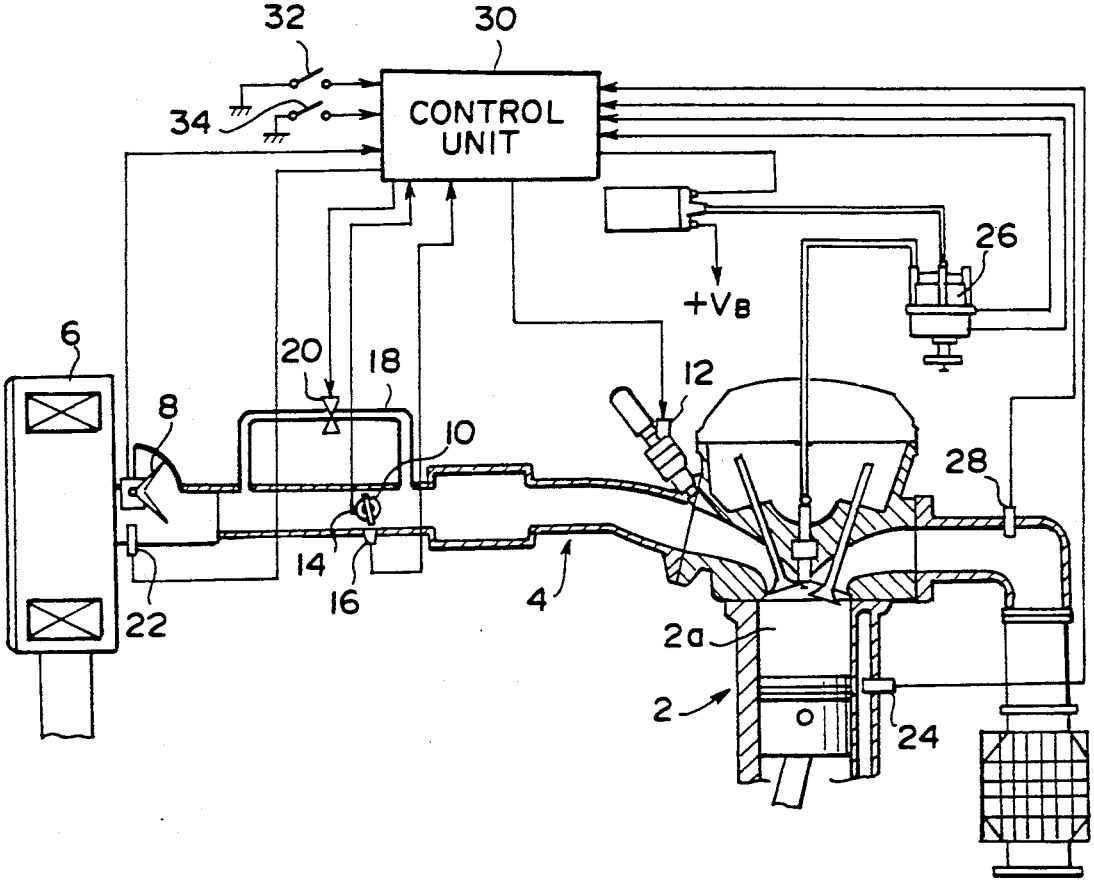
FIG. 9 is a schematic view showing the mechanical arrangement of the system.
Figure 10:
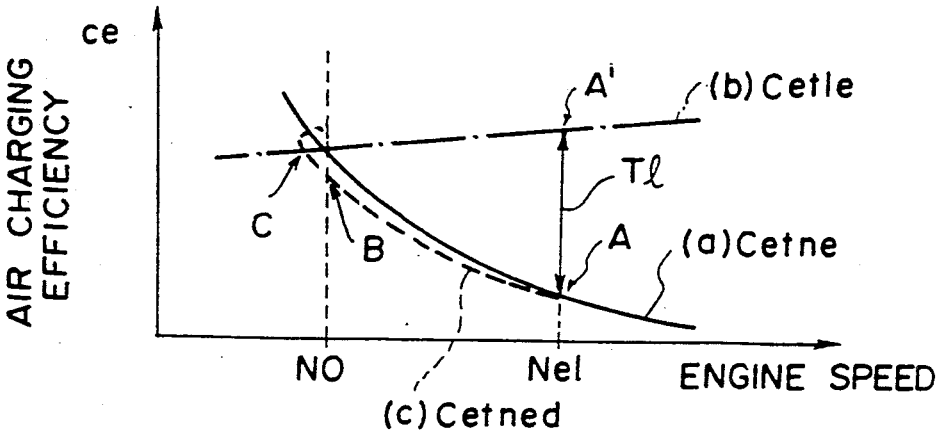
FIG. 10 is a view for illustrating how the engine speed falls.
Figure 11:
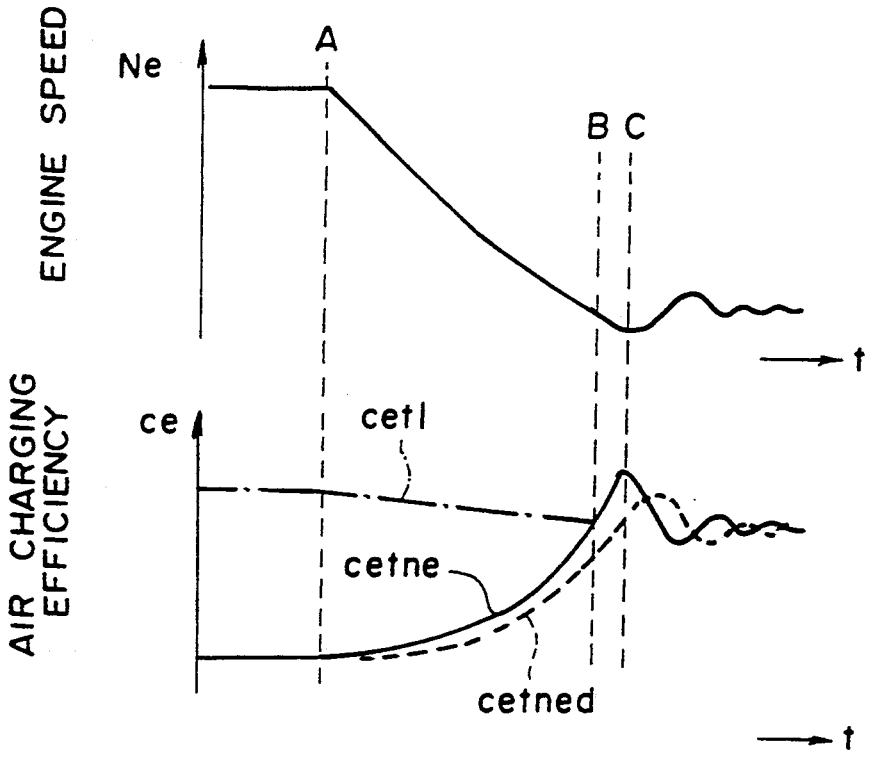
FIG. 11 is a view for illustrating how the engine speed falls on time base.

An idle speed control system in accordance with an embodiment of the present invention is substantially equal to the system shown in FIG. 9 in the mechanical arrangement but differs from that in the control executed by the control unit 30. Accordingly, the idle speed control system of this embodiment will be described hereinbelow mainly on the control executed by the control unit 30.

In this embodiment, the control unit 30 calculates a basic air charging efficiency Cebase required to fixedly operate the engine 2 at a target idle speed No, calculates a first target air charging efficiency Cetno by feedback correction of the basic air charging efficiency Cebase on the basis of a correction value Cefb which is determined according to the difference between an actual idle speed Ne and a target idle speed No, calculates a second target air charging efficiency Cetne which is the air charging efficiency obtained when the engine 2 is fixedly operated at a detected idle speed Ne while the amount of intake air is kept at a mass flow Gno which will fixedly provide the first target air charging efficiency Cetno, calculates a final target mass flow Gtotal which provides a first-order lag air charging efficiency Cetned equal to the second target air charging efficiency Cetne, the first-order lag air charging efficiency being an air charging efficiency which is actually introduced into the cylinder 2a when the opening of the idle speed regulator valve 20 is set so that a given mass flow is obtained, and controls the opening of the idle regulator valve 20 on the basis of the final target mass flow Gtotal.

Figure 1A:
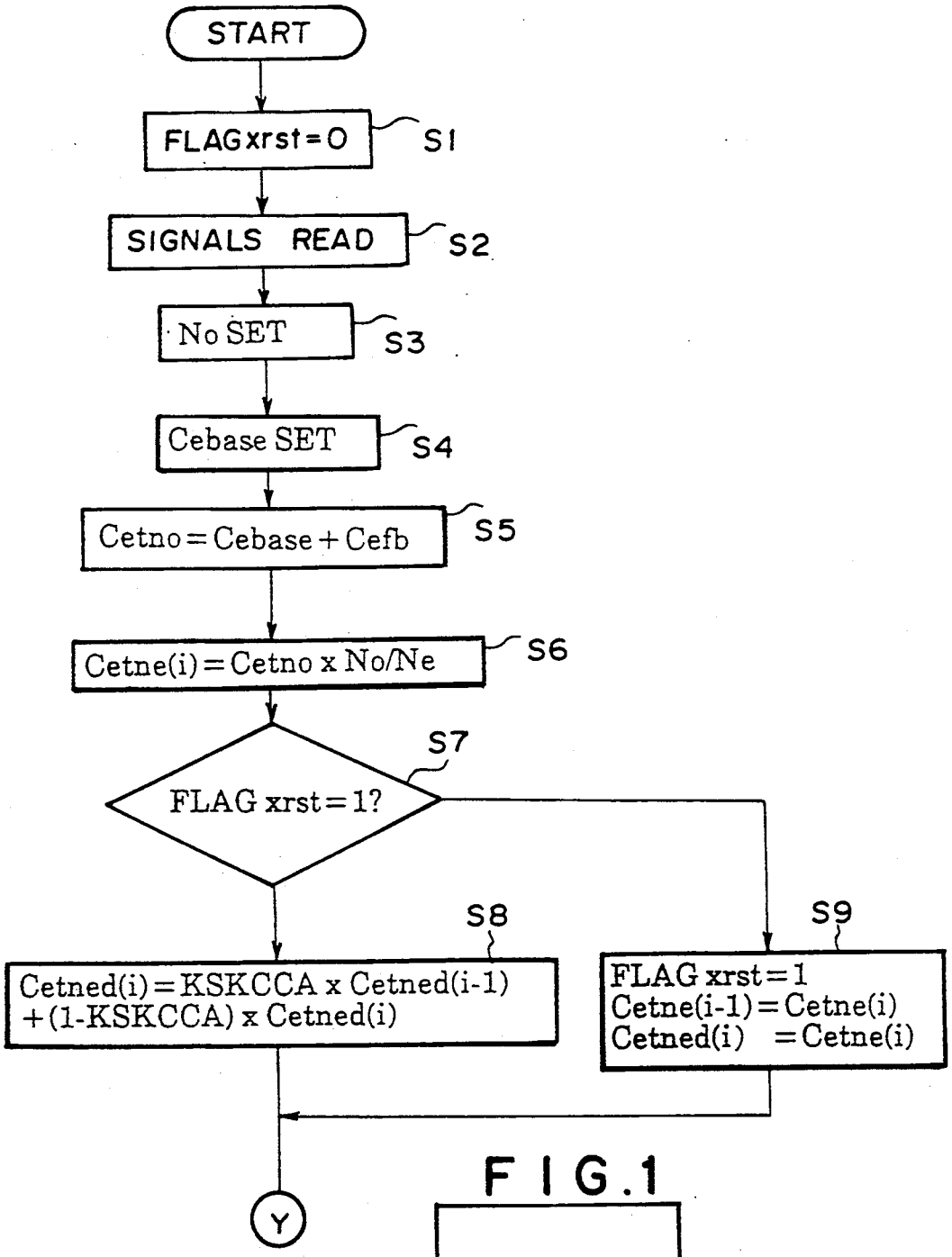
FIGS. 1, 1A and 1B are flow charts for illustrating the control which the control unit of an idle control system in accordance with an embodiment of the present invention executes.
Figure 1:
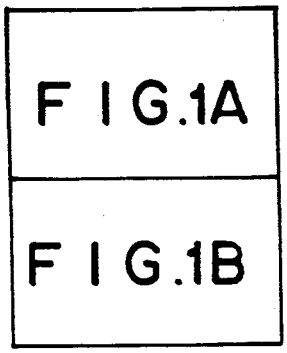
Figure 1B:
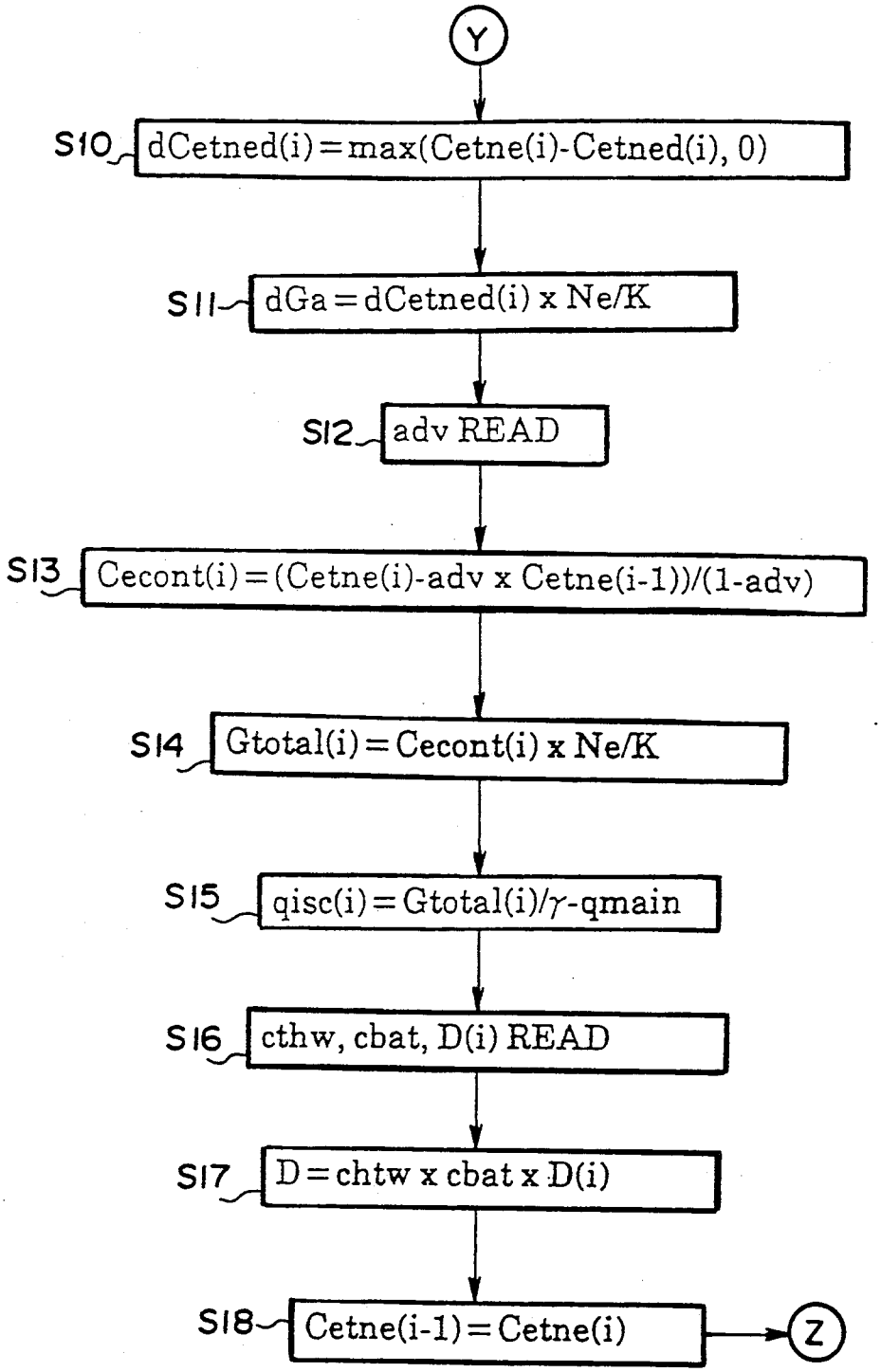

When the idle switch 16 is turned on, the control unit 30 repeats the control shown in FIG. 1 every stroke cycle of the engine 2.

In step S1, the control unit 30 sets off flag xrst (xrst=0) which indicates that it is a first run. Then in step S2, the control unit 30 reads information on the operating condition of the engine 2 and on operation of the auxiliary mechanisms from the outputs of the sensors and switches such as the engine speed sensor 26, the airflow sensor 8, the air conditioner switch 32, the power steering switch 34 and the like.

Figure 2:
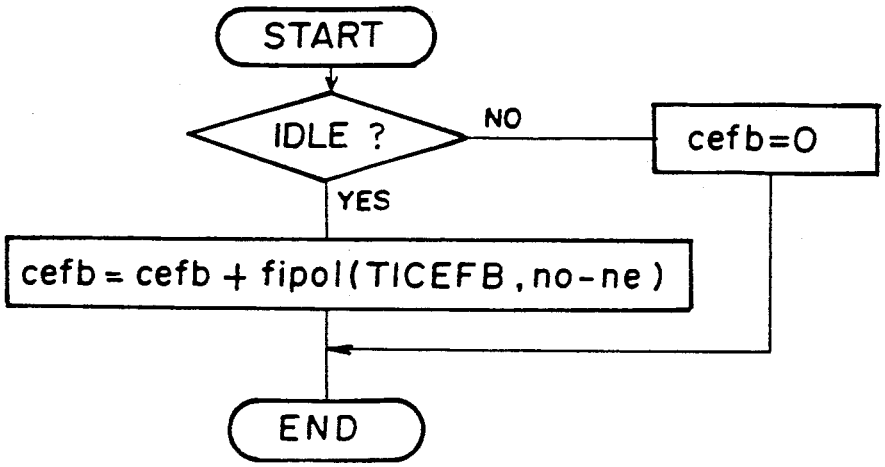
FIG. 2 is a flow chart of an interruption routine for calculating a feedback correction value.
Figure 3:
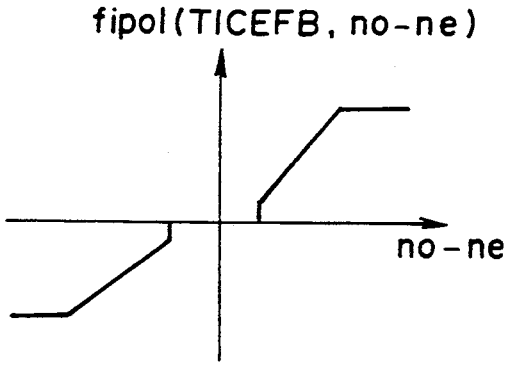
FIG. 3 is a characteristic graph for calculating the feedback correction value.

In step S3, the control unit 30 determines a target idle speed No according to the engine coolant temperature and whether external load is acting on the engine 2. Then the control unit 30 calculates a basic air charging efficiency Cebase required to fixedly operate the engine 2 at the target idle speed No, and calculates a first target air charging efficiency Cetno by adding to the basic air charging efficiency Cebase a feedback correction value Cefb which is determined according to the difference between a detected actual idle speed Ne and a target idle speed No. (steps S4 and S5) The feedback correction value Cefb is read out from the characteristic graph shown in FIG. 3 at predetermined intervals (e.g., of 160 msec) according to the flow chart shown in FIG. 2.

In step S6, the control unit 30 calculates a second target air charging efficiency Cetne(i) (=Gno/Ne) which is the air charging efficiency obtained when the engine 2 is fixedly operated at the detected idle speed Ne while the amount of intake air is kept at a first target mass flow Gno which will fixedly provide the first target air charging efficiency Cetno.

Then in step S7, the control unit 30 determines whether the flag xrst is on (xrst=1). When it is determined that the flag xrst is 1, i.e., that it is not the first run, the control unit 30 proceeds to step S8 and calculates a first-order lag air charging efficiency Cetned(i) which is actually introduced into the cylinder 2a when the opening of the idle speed regulator valve 20 is set so that the first target mass flow Gno is obtained. The first-order lag air charging efficiency Cetned(i) is calculated according to the following formula as described above in conjunction with the prior art.

$$Cetned(i)=KSKCCA\cdot Cetned(i-1)+(1-KSKCCA)\cdot Cetne(i)$$

The first-order lag air charging efficiency Cetned(i) is substantially definitely determined according to the specification of the engine.

When it is determined in step S7 that the flag xrst is not 1, the control unit 30 proceeds to step S9. In step S9, the control unit 30 sets the preceding value Cetne(i−1) of the second target air charging efficiency to the value of the second target air charging efficiency Cetne(i) as detected in step S6, and sets the present value Cetned(i) of the first-order lag air charging efficiency to the value of the value of the second target air charging efficiency Cetne(i) as detected in step S6.

Then step S10, the control unit 30 calculates the difference between the first-order lag air charging efficiency Cetned(i) and the second target air charging efficiency Cetne(i). In this particular embodiment, only the case where the former is smaller than the latter is taken into consideration and the charging efficiency shortage dCetned=Max(Cetno-Cetned, 0) is calculated.

Figure 4:
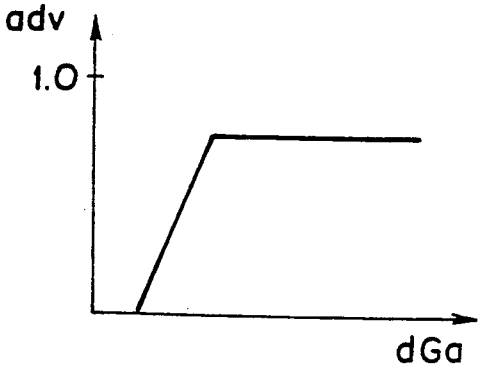
FIG. 4 is a characteristic graph for calculating a first-order lead coefficient.

The in step S11, the control unit 30 calculates an air mass flow shortage $dGa=dCetned\cdot Ne/K$ corresponding to the charging efficiency shortage dCetned, and in step S12, the control unit 30 reads out a first-order advance coefficient adv for compensating for the air mass flow shortage dGa from the characteristic graph shown in FIG. 4. In the next step S13, the control unit 30 calculates a final target air charging efficiency Cecont which provides a first-order lag air charging efficiency Cetned(i) equal to the second target air charging efficiency Cetne(i) according to the following formula.

$$Cecont(i)=[Cetne(i)-adv\cdot Cetne(i-1)]/(1-adv)$$

In step S14, the control unit 30 calculates a final target mass flow Gtotal(i) on the basis of the final target air charging efficiency Cecont(i), that is, $Gotal(i)=Cecont(i)\cdot Ne/K$. Then in the next step S15, the control unit 30 calculates a volume flow qisc of air to be permitted to flow through the idle regulator valve 20 on the basis of the final target mass flow Gtotal(i) according to the following formula.

$$qisc=Gtotal(i)/\gamma-qmain$$

wherein qmain represents the volume flow of air which leaks through the throttle valve 10.

Figure 5:
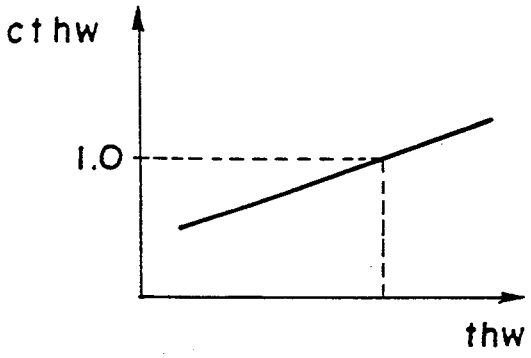
FIG. 5 is a characteristic graph for calculating a coil-temperature correction coefficient.
Figure 6:
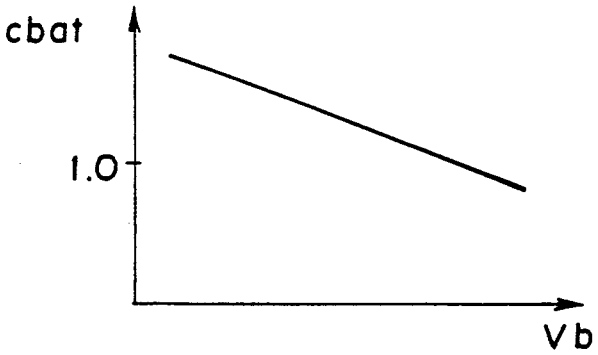
FIG. 6 is a characteristic graph for calculating a battery-voltage correction coefficient.
Figure 7:
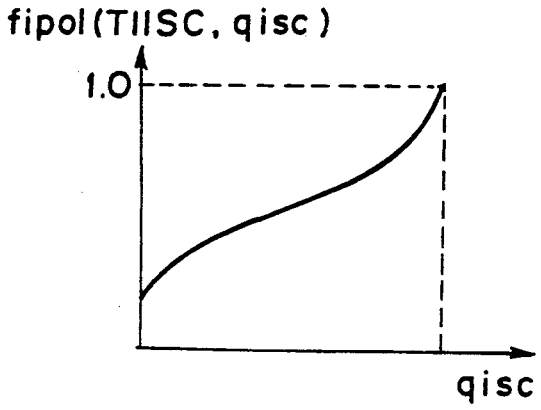
FIG. 7 is a characteristic graph for calculating the control duty.

In step S16, the control unit 30 reads out a coil-temperature correction coefficient cthw, a battery-voltage correction coefficient cbat and a control duty D(i) based on the volume flow qisc of air to be permitted to flow through the idle regulator valve 20 respectively from the characteristic graphs shown in FIGS. 5, 6 and 7. Then in step S17, the control unit 30 calculates a final control duty D (=cbat·cthw·D(i)), and controls the opening of the idle regulator valve 20 on the basis of the final control duty D.

Then the control unit 30 returns to step S20 after setting the present value of the second target air charging efficiency Cetne as the preceding value Cetne(i−1).

Figure 8:
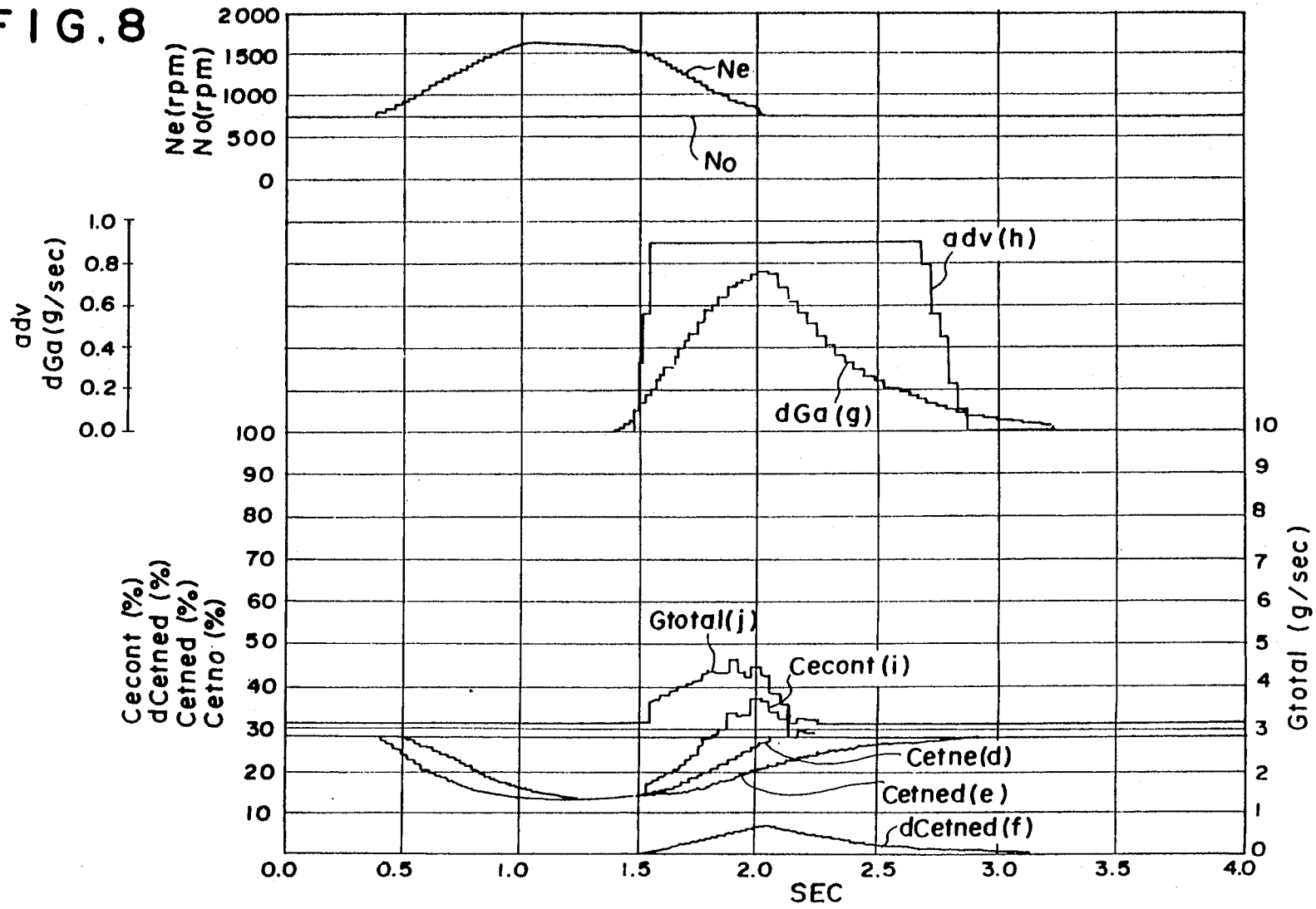
FIG. 8 shows a simulation of the control to be executed in the embodiment.

The graph shown in FIG. 8 shows a simulation of the control described above. In FIG. 8, line d shows the change of the second target air charging efficiency Cetne in an ideal state, and line e shows the change of the first-order lag air charging efficiency Cetned which is expected to be actually introduced into the cylinder 2a when the opening of the idle regulator valve 20 is controlled on the basis of the second target air charging efficiency Cetne in the ideal state. Line f shows the change of the charging efficiency shortage dCetned by which the first-order lag air charging efficiency Cetned(i) is smaller than the second target air charging efficiency Cetne(i).

Line g in FIG. 8 shows the change of the air mass flow shortage $dGa=dCetned\cdot Ne/K$ corresponding to the charging efficiency shortage dCetned, line h shows the change of the first-order advance coefficient adv for compensating for the air mass flow shortage dGa, and line i shows the change of the final target air charging efficiency Cecont. Further line j shows the change of the final target mass flow Gtotal. The opening of the idle regulator valve 20 is controlled on the basis of the final target mass flow Gtotal.

When the opening of the idle regulator valve 20 is controlled on the basis of the final target mass flow Gtotal, the change of the first-order lag air charging efficiency which is actually introduced into the cylinder 2*a* substantially conforms to the change of the second target air charging efficiency Cecont which is in an ideal state, and accordingly, the first-order lag air charging efficiency which is actually introduced into the cylinder 2*a* can be approximated, at the time the actual engine speed Ne comes to conform to the target idle speed No, to the air charging efficiency required to thereafter keep the engine speed at the target idle speed No, whereby fall of the engine speed due to shortage of the air charging efficiency (undershoot) or hunting of the engine speed accompanying the fall of the engine speed can be prevented and the actual engine speed Ne can be better converged on the target idle speed No.

The control program for executing the control described above can be relatively simply prepared so long as the first-order lag coefficient KSKCCA for calculating the first-order lag air charging efficiency and the first-order advance adv can be obtained. Further, the control program per se can be applied to various engine having different specifications so long as the first-order lag coefficient KSKCCA and the first-order advance adv are known for each engine and accordingly can be obtained at low cost. Unlike the mass flow, the air charging efficiency does not depend upon the displacement of the engine and accordingly, various data for controlling the idle speed need not be changed according to the displacement of the engine, whereby setting is facilitated.

As can be understood from the description above, in accordance with the present invention, change of the air charging efficiency during a transient period when the engine operates at any speed while the engine speed is going to converge on a target idle speed can be substantially conformed to a change of the air charging efficiency which is ideal to cause the actual idle speed to converge on the target idle speed. Accordingly, the engine output torque at the time the actual idle speed transiently conforms to the target idle speed can be substantially equalized to the value required to fixedly operate the engine at the target idle speed, whereby undershoot or hunting of the engine speed can be substantially prevented and the actual engine speed can be better converged on the target idle speed. Further unlike the mass flow, the air charging efficiency does not depend upon the displacement of the engine and accordingly, various data for controlling the idle speed need not be changed according to the displacement of the engine, whereby setting is facilitated.

What is claimed:

1. An idle speed control system for an engine comprising an idle regulator valve which controls the amount of intake air to be fed to the engine when the engine idles and a control unit which detects an engine speed and controls the opening of the idle regulator valve so that the detected engine speed converges on a target idle speed, characterized in that said control unit has a basic air charging efficiency calculating means which calculates a basic air charging efficiency required to fixedly operate the engine at the target idle speed, a first target air charging efficiency calculating means which calculates a first target air charging efficiency by feedback correction of the basic air charging efficiency on the basis of a correction value which is determined according to the difference between the detected engine speed and the target idle speed, a second target air charging efficiency calculating means which calculates a second target air charging efficiency which is the air charging efficiency obtained when the engine is fixedly operated at the detected engine speed while the amount of intake air is kept at a mass flow which will fixedly provide the first target air charging efficiency, a final target mass flow calculating means which calculates a final target mass flow which provides a first-order lag air charging efficiency equal to the second target air charging efficiency, the first-order lag air charging efficiency being an air charging efficiency which is actually introduced into the cylinder when the opening of the idle speed regulator valve is set so that a given mass flow is obtained, and a valve control means which controls the opening of the idle regulator valve on the basis of the final target mass flow.

* * * * *